US008963707B2

(12) United States Patent
Bevel

(10) Patent No.: US 8,963,707 B2
(45) Date of Patent: Feb. 24, 2015

(54) ALERT AND VERIFICATION SYSTEM

(76) Inventor: Douglas Bevel, Chicago, IL (US)

( * ) Notice: Subject to any disclaimer, the term of this patent is extended or adjusted under 35 U.S.C. 154(b) by 452 days.

(21) Appl. No.: 12/584,013

(22) Filed: Aug. 27, 2009

(65) Prior Publication Data

US 2011/0050409 A1 Mar. 3, 2011

(51) Int. Cl.

| | |
|---|---|
| ***G08B 1/08*** | (2006.01) |
| ***A61J 7/04*** | (2006.01) |
| *A61J 1/03* | (2006.01) |

(52) U.S. Cl.

CPC . *A61J 7/0481* (2013.01); *A61J 1/03* (2013.01); *A61J 7/0409* (2013.01)

USPC ..... 340/539.12; 340/501; 340/573.1; 368/10; 368/109; 221/2; 221/9

(58) Field of Classification Search

USPC ..... 340/572.1, 573.1, 501, 539.12; 221/2, 221/9; 368/10, 109

See application file for complete search history.

(56) References Cited

U.S. PATENT DOCUMENTS

| | | | | |
|---|---|---|---|---|
| 5,099,463 | A * | 3/1992 | Lloyd et al. | 368/10 |
| 5,157,640 | A * | 10/1992 | Backner | 368/10 |
| 5,583,831 | A * | 12/1996 | Churchill et al. | 368/10 |
| 5,752,235 | A * | 5/1998 | Kehr et al. | 702/177 |
| 6,075,755 | A * | 6/2000 | Zarchan | 368/10 |
| 6,102,855 | A * | 8/2000 | Kehr et al. | 600/300 |
| 6,674,358 | B1 * | 1/2004 | Tinsley | 340/7.63 |
| 7,081,807 | B2 * | 7/2006 | Lai | 340/309.7 |
| 7,158,011 | B2 * | 1/2007 | Brue | 340/309.16 |
| 2001/0028308 | A1 * | 10/2001 | De La Huerga | 340/573.1 |
| 2002/0009018 | A1 * | 1/2002 | Patella | 368/108 |
| 2003/0151499 | A1 * | 8/2003 | Huang | 340/309.16 |
| 2004/0252030 | A1 * | 12/2004 | Trimble et al. | 340/825.36 |
| 2005/0117455 | A1 * | 6/2005 | Valerio | 368/10 |
| 2006/0139150 | A1 * | 6/2006 | Brue | 340/309.16 |
| 2006/0215495 | A1 * | 9/2006 | Soled et al. | 368/10 |
| 2006/0290490 | A1 * | 12/2006 | Kraus et al. | 340/539.18 |
| 2007/0096933 | A1 * | 5/2007 | Enitan et al. | 340/686.6 |
| 2007/0194890 | A1 * | 8/2007 | Brue | 340/309.16 |
| 2008/0054007 | A1 * | 3/2008 | Mador | 221/1 |
| 2009/0040874 | A1 * | 2/2009 | Rooney et al. | 368/10 |
| 2009/0284355 | A1 * | 11/2009 | Kiran | 340/309.16 |
| 2009/0295575 | A1 * | 12/2009 | Kennedy | 340/540 |
| 2010/0045455 | A1 * | 2/2010 | Mazzolini et al. | 340/521 |
| 2010/0283601 | A1 * | 11/2010 | Tai et al. | 340/539.12 |

* cited by examiner

*Primary Examiner* — Hoi Lau
(74) *Attorney, Agent, or Firm* — Law Office of Marc D. Machtinger, Ltd.

(57) ABSTRACT

System for an event alert signal and verifying the completion of event is disclosed. The system may include at least one alert device for generating alert for certain events. The system may also include at least one destination device that may be configured to be communicating with the alert device and may be associated with the event. The system may verify completion of the event when the alert device may be deactivated upon the user's completion of the event.

5 Claims, 1 Drawing Sheet

ALERT AND VERIFICATION SYSTEM

BACKGROUND

1. Field

This disclosure is generally related to alert and verification systems, and more particularly, to techniques for providing an event alert signal and verifying the completion of event.

2. Background

The previous attempts remain inadequate because the prior art systems allow users to turn off alerts. Prior art systems do not verify completion of required tasks or events. Another problem with prior art systems is that these systems enable users to turn off the alert signal before completion of the event.

SUMMARY

Disclosed herein is a new and improved approach for an alert and verification systems. A system for alerting to an event and verifying the completion of at least one event is disclosed here. The system may include at least one alert device that may be configured to generate an alert for alerting a user to an event. The system may also include a destination device that may be configured to communicate with the alert device. The destination device may be associated with the event. To verify completion of the event, the alert device may be configured to be deactivated upon the user's completion of the event.

In an embodiment, the alert device may also include a deactivation key, and the destination device may include a receptor for receiving the deactivation key for deactivating the alert upon proximate contact. The destination device may be configured to be associated with a medication dispenser so that deactivating the alert device may cause dispensing of the medication.

Other systems, methods, aspects, features, embodiments and advantages of the improved approach for an alert and verification system disclosed herein will be, or will become, apparent to one having ordinary skill in the art upon examination of the following drawings and detailed description. It is intended that all such additional systems, methods, aspects, features, embodiments and advantages be included within this description, and be within the scope of the accompanying claims.

BRIEF DESCRIPTION OF THE DRAWINGS

It is to be understood that the drawings are solely for purpose of illustration. Furthermore, the components in the figures are not necessarily to scale, emphasis instead being placed upon illustrating the principles of the apparatuses, articles of manufacture and methods disclosed herein. In the figures, like reference numerals designate corresponding parts throughout the different views.

DETAILED DESCRIPTION

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

The word "exemplary" is used herein to mean "serving as an example, instance, or illustration." Any embodiment, component or variant described herein as "exemplary" is not necessarily to be construed as preferred or advantageous over other embodiments, components or variants. All of the embodiments, components and variants described in this description are exemplary embodiments, components and variants provided to enable persons skilled in the art to make and use the invention, and not necessarily to limit the scope of legal protection afforded the appended claims.

Figure 1:
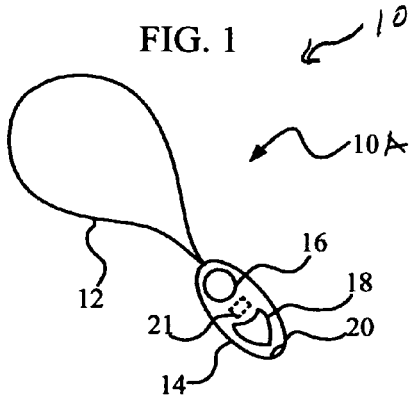
FIG. 1 is an alert device according to the present invention.

FIG. 1 shows a system 10 that may include an alert device 10A that may be worn about, and/or secured to, the body of a user (not shown). For example, alert device 10A may be worn as a necklace. Exemplary alert device 10A illustrated includes a securing device 12, an alarm housing 14, a speaker 16, a light 18, and a user key 20. The securing device may be, but is not limited to, a chain, a bracelet, a rope, a string, a broach, a pin, etc, and any device that may allow for the alarm housing to be kept near the user.

Alarm housing 14 may be made of any material known to those having ordinary skill in the art. In some embodiments, alarm housing 14 may be an inexpensive material, such as plastic. In other embodiments, alarm housing 14 may be constructed from more attractive materials to enhance the visual appeal of alert device 10A as it may be worn in public and used as jewelry.

Alarm housing 14 may include components to alert the user to the need for an event to occur, such as, but not limited to, the need to take or administer a medication. The alerting components may include one or more components for issuing audible alerts, such as but not limited to speaker 16, components for issuing visual alerts such as but not limited to light 18, and components for issuing tactile alerts such as but not limited to a vibrating device (not shown).

Figure 2:
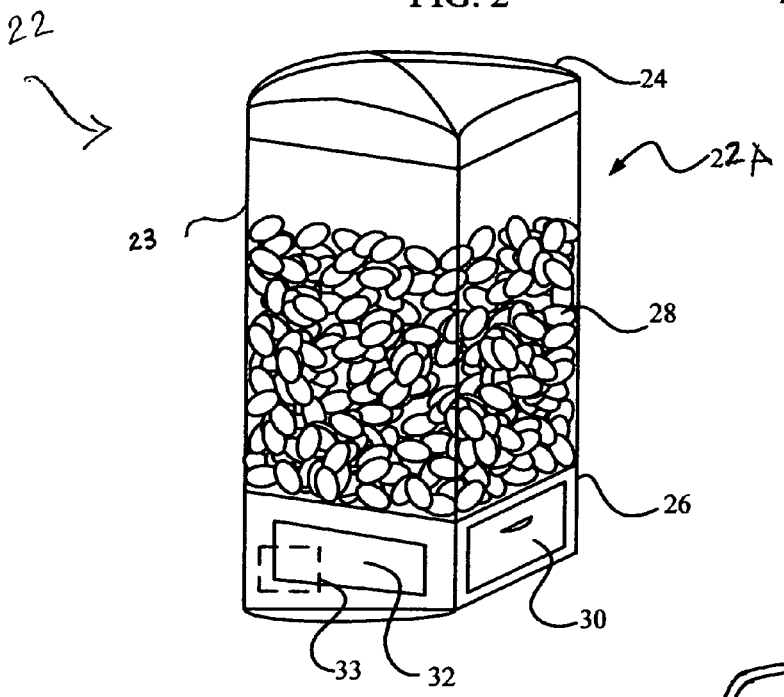
FIG. 2 and FIG. 3 illustrate an application for the present invention in the medical field.

System 10 may also include a destination device 22, as shown in FIG. 2. Destination device 22 may include dispenser 22A. Dispenser 22A may include a storage portion 23, a cover 24, and a bottom portion 26. In some exemplary embodiments, storage portion 23 may be configured to store medication, such as pills. Further, in some exemplary embodiments, storage portion 23 may be configured to store a plurality of individual sets of medication that may be required by a user on a plurality of cycles and/or at different times of the day.

Dispenser 22A may include a portion for dispensing the contents of the storage portion 23, for example by dispensing the contents of the storage portion 23 at one time, or a subset of the contents of the storage portion, for example a single dose 28 or a plurality of doses of a plurality of items stored in the storage portion 23. The contents of the storage portion 23, for example dose 28, may be dispensed via drawer 30.

Dispenser 22A may also include a programming device 33 that may include a programming pad 32. Programming pad 32 may be used to program dispenser 22A to dispense the contents of the storage portion 23 based on a plurality of schedules, for example based on prescriptions for medications associated with the user. Programming device 33 may be any type of computing device known to those having skill in the art, such as a programmable controller that may be configured to operate dispenser 22A as described herein. Programming device 33 may include a clock for allowing dispenser 22A to be operated pursuant to a programmable schedule. In some embodiments, dispenser 22A may be programmed through a remote control device, or in a variety of other manners known to those having ordinary skill in the art. Dispenser 22A may be programmed by a pharmacy, a physician office, a user or any third party.

Programming device 33 may also send a signal to alert device 10A to trigger an alert and/or an alarm. That alert and/or alarm may then be used to make the user aware that the contents of, or a portion of the contents of, the storage portion 23 are available to the user. In some exemplary embodiments, programming device 33 may send a signal to a programmer/receiver 21 of alert device 10A. The signal may include information such as, but not limited to, the trigger for the alert and/or alarm.

In some exemplary embodiments, alert device 10A may activate the alerting components, such as the speaker 16, the light 18, and the vibrator (not shown), until alert device 10A is deactivated when user places user key 20 in proximity to dispenser 22, to verify completion of the event.

Figure 3:
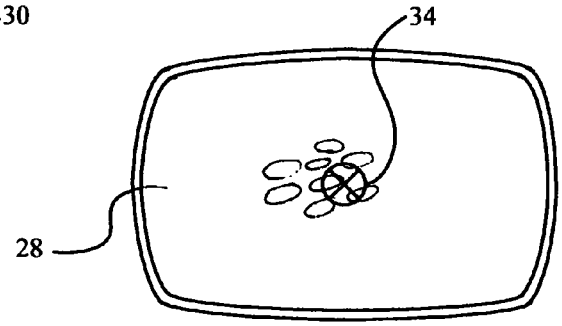

FIG. 3 shows another embodiment according to the present invention. When certain medications pills are due, programming device 33 may send a signal to alert device 10A to trigger an alert and/or an alarm. The alert may be used to make the user aware that certain medication pills 28 are due and available. To verify completion of the event here, which is taking certain medications pills, alert device 10A may only be deactivated when a user places user key 20 in proximity with a dispensing key 34 that may be secured to the bottom of drawer 30 and that may include or covered by medication dose 28.

The various circuits used herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors or DSPs, one or more microprocessors in conjunction with a DSP core, or any other such configuration.

Software/firmware implementing any of the functions, blocks or processes disclosed herein may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC.

The ASIC may reside in a user terminal. In the alternative, the processor and the storage medium may reside as discrete components in a user terminal.

If implemented in software, the methods, blocks, algorithms, and functions described herein may be stored on or transmitted over as instructions or code on one or more computer-readable media. Computer-readable medium includes both computer storage medium and communication medium, including any medium that facilitates transfer of a computer program from one place to another. A storage medium may be any available medium that can be accessed by a computer. By way of example, and not limitation, such computer-readable medium can comprise RAM, ROM, EEPROM, CDROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable medium.

The above description of the disclosed embodiments is provided to enable any person skilled in the art to make or use that, which is defined by the appended claims. The following claims are not intended to be limited to the disclosed embodiments. Other embodiments and modifications will readily occur to those of ordinary skill in the art in view of these teachings. Therefore, the following claims are intended to cover all such embodiments and modifications when viewed in conjunction with the above specification and accompanying drawings.

The invention claimed is:

1. A system for alerting to an event and verifying the completion of at least one event, comprising:

(a) at least one alert device, the device being configured to generate an alert for alerting a user to the at least one event at regular periodic time intervals, and configured to be attached to a user;

(b) at least one destination device configured to communicate with the at least one alert device, the destination device being associated with the at least one event, wherein the at least one alert device is configured to be deactivated upon the user's completion of the event, wherein the event is associated with at least one medication container, and wherein the at least one alert device continues the alert until the user places said alert device in proximity with at least a portion of said at least one medication container, wherein the destination device includes a deactivation key separate from said alert device, for deactivating the alert device upon proximate contact, wherein the destination device is attached to or part of the at least one medication container, and wherein the alert device is entirely contained within a wearable item.

2. The system of claim 1 wherein the destination device is configured to be associated with at least one medication dispenser so that deactivating the alert device causes dispensing of the medication.

3. The system of claim 1 wherein the alert device is user-programmable to produce alert signals upon occurrence of certain events.

4. A system for alerting to an event and verifying the completion of the event, comprising:

(a) at least one alert device adapted to be associated with the user, the device being configured to initiate an alert for alerting the user to take a certain action at regular periodic time intervals, wherein the at least one device cannot be deactivated by the user without the user taking the action, wherein the alert device continues to generate the alert until the certain action is taken by the user, and wherein the at least one alert device is securely attached to the user, wherein the action includes placing said alert device in proximity with at least one medication container; and (b) at least one destination device configured to communicate with the at least one alert device, wherein the at least one alert device is configured to be deactivated upon the user's completion of the action, wherein the alert device includes a deactivation key separate from said alert device for deactivating the alert upon proximate contact, the at least one destination device being attached to or part of at least one medication container, and wherein the alert device is entirely contained within a wearable item.

5. The system of claim 4 wherein the destination device is configured to be associated with the at least one medication container and wherein deactivating the alert device causes dispensing of the medication.

* * * * *